United States Patent [19]

Yamazaki et al.

[11] 4,316,122

[45] Feb. 16, 1982

[54] HIGH PRESSURE SODIUM VAPOR DISCHARGE LAMP

[75] Inventors: Haruo Yamazaki, Moriyama; Yoshiro Ogata, Ibaraki; Hidezoh Akutsu, Kobe, all of Japan

[73] Assignee: Matsushita Electronics Corporation, Kadoma, Japan

[21] Appl. No.: 81,557

[22] Filed: Oct. 3, 1979

[51] Int. Cl.[3] ..... H01J 7/44; H01J 17/34; H01J 19/78; H01J 23/16

[52] U.S. Cl. ..... 315/74; 313/188; 313/197; 315/47

[58] Field of Search ..... 315/47, 50, 64, 67, 315/65, 74, 75; 313/188, 197

[56] References Cited

U.S. PATENT DOCUMENTS

| | | | |
|---|---|---|---|
| 2,663,823 | 12/1953 | Elenbaas et al. | 315/47 X |
| 2,775,718 | 12/1956 | Dubilier | 313/197 X |
| 2,784,347 | 3/1957 | Thouret | 315/47 |
| 3,721,845 | 3/1973 | Cohen et al. | 315/47 |
| 3,721,846 | 3/1973 | Cohen | 315/47 |
| 3,746,914 | 7/1973 | Olson et al. | 315/47 |
| 4,137,483 | 1/1979 | Ochi et al. | 315/47 |
| 4,179,640 | 12/1979 | Larson et al. | 315/47 |

*Primary Examiner*—Saxfield Chatmon, Jr.
*Attorney, Agent, or Firm*—Cushman, Darby & Cushman

[57] ABSTRACT

A high pressure sodium vapor discharge lamp, characterized in that its discharge tube contains xenon gas at a high pressure of e.g. over 150 torr, at least one of discharge electrodes has a projection conductor which is disposed extending therefrom towards an inside surface of a side wall of a tube envelope of the discharge tube in a manner that outer end of the projection conductor is disposed in proximity to a side wall of said tube envelope with a predetermined gap in-between and a starting aid conductor is disposed lengthwise on the outside surface of the side wall, and connected to the other electrode.

5 Claims, 7 Drawing Figures

HIGH PRESSURE SODIUM VAPOR DISCHARGE LAMP

BACKGROUND OF THE INVENTION

1. Field of the Invention

The present invention relates to an improvement in a high pressure sodium vapor discharge lamp which comprises a translucent gas-discharge tube having therein sodium, buffer gas and xenon gas.

2. Description of the Prior Art

Generally speaking, high pressure sodium vapor discharge lamps have about a twice high efficiency in comparison with the conventional high pressure mercury lamp and have a comfortable color appearance, and therefore are attracting attention as energy saving light sources to replace the high pressure mercury lamp in the near future. In a discharge tube of a conventional high pressure sodium vapor discharge lamp, xenon gas is sealed to have a pressure of about 20 Torr, as a starting gas having a low thermal conductivity. As a result of the addition of xenon gas, a starting voltage of the high pressure sodium vapor discharge lamp is as high as about 2 KV, which is very high in comparison with less than 200 V of the mercury lamp. Recently, a high efficiency high pressure sodium vapor discharge lamp has been proposed, wherein xenon is filled with a pressure of over 150 Torr, for example, 350 Torr, thereby raising lamp efficiency by about 10% higher than those having xenon gas filled with a pressure of about 20 Torr, has been proposed. In such a lamp with high pressure xenon gas, the starting voltage of the lamp is further raised, for example, to about 8–9 KV for a high pressure sodium vapor discharge lamp having xenon gas filled with the pressure of 350 Torr. In such a lamp, the starting voltage can be lowered to about 3.5 KV for a 360 W high pressure sodium discharge lamp when utilizing a starting aid wire, but such voltage of 3.5 KV is still higher for actual use and liable to induce breakdown of insulation of a ballast and a related lamp circuit.

SUMMARY OF THE INVENTION

The object of the present invention is to provide a high pressure sodium vapor discharge lamp filled with a very high pressure xenon gas but having a low starting voltage thereby enabling to provide a lamp set without fear of breakdown of insulation.

The object of the present invention is attained by utilizing a starting aid conductor formed lengthwise on the outside wall of a discharge tube thereof and also a projection of a conductor which is disposed extending from an electrode thereof towards the tube wall and connected to one electrode.

In accordance with the present invention, a starting voltage of the high pressure sodium vapor discharge lamp having a high pressure xenon gas of 150 to 350 Torr can be reduced to such a low voltage of 3 KV or lower.

DESCRIPTION OF THE PREFERRED EMBODIMENT

A high pressure sodium vapor discharge lamp in accordance with the present invention comprises an outer bulb enclosing a discharge tube in an evacuated space therein, said discharge tube comprising a translucent and chemically stable tube envelope containing therein sodium, xenon gas, a buffer gas which is at least one member selected from the group consisting of mercury and cadmium, and discharge electrodes sealed in both end parts of said tube envelope, and is characterized in that at least one of said discharge electrodes has a projection conductor which is disposed extending therefrom towards and in proximity to an inside surface of a side wall of said tube envelope with a predetermined gap inbetween and that a starting aid conductor is disposed lengthwise on the outside surface of said side wall in a manner to face outer end part of said projection conductor via said side wall, said starting aid conductor having a connection which impresses a potential substantially identical to that of the other discharge electrode.

The inventors made many experiments concerning starting characteristics of high pressure sodium vapor discharge lamps having xenon gas filled therein as a starting gas. As a result of the experimental study, the inventors found that a starting voltage of the lamp can be lowered by a large margin, by providing a protrusion of a conductor (metal) extending from either one of the electrodes towards the inside surface of the side wall of the tube envelope, providing a starting aid conductor stripe (wire) on the outside surface of said side wall and applying a potential which is substantially identical to that of the other electrode, on the starting aid conductor. The present invention is made in accordance with the abovementioned finding.

Figure 1:
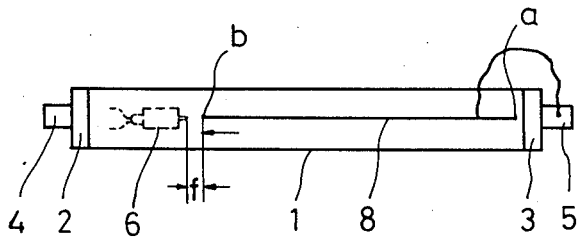
FIG. 1 is a plan view of a discharge tube of a high pressure sodium vapor discharge lamp without a projection of conductor at its electrodes.
Figure 2:
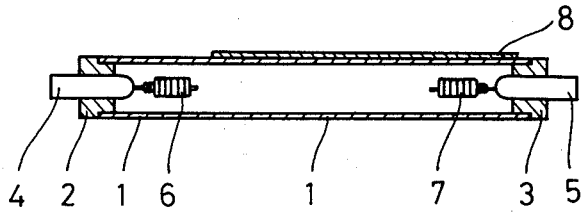
FIG. 2 is a sectional elevation view of the lamp shown in FIG. 1.

The experiments leading to the present invention and the details of the example of the present invention are elucidated referring to the accompanying drawings. As shown in FIG. 1 and FIG. 2, the discharge tube, which is to be disposed in an evacuated outer glass bulb, has a translucent tube envelope 1 of a polycrystalline alumina ceramic tube or a single crystal aluminum tube and a pair of electrodes 6 and 7. The electrodes 6 and 7 are made of tungsten coils, carry an electron-emitting substance therein and are disposed in and near both ends of the tube envelope 1 by supportings by lead-in wires 4 and 5 of niobium tubes, which penetrate and are fixed to end caps 2 and 3. In the tube envelope 1 is sealed sodium as light emitting substance, mercury as a buffer gas and xenon as a starting rare gas. A starting aid conductor stripe 8 made of a molybdenum wire of 0.8 mm diameter is disposed on the outer surface of the wall of the tube envelope 1 and is connected to one electrode terminal 5.

Figure 3:
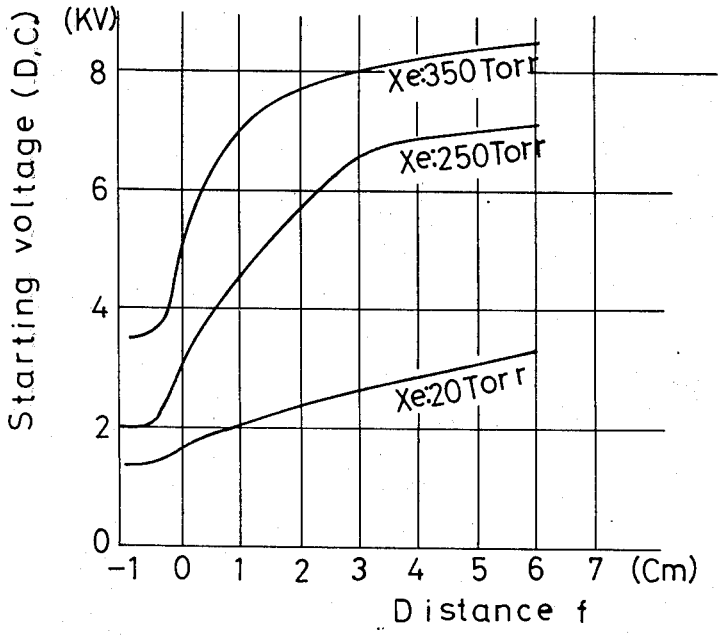
FIG. 3 is a graph showing relations between distances "f" from the end tip of an electrode to the end tip of a starting aid conductor and starting voltages for D.C. operations of the discharge tube of FIGS. 1 and 2.

The inventors made experiments to study how the starting voltage of the discharge tube changes as one end "b" of the starting aid conductor 8 changes its position with respect to one electrode 6, while the other end "a" is fixed substantially to the end of the tube envelope 1 and electrically connected to the other electrode 7, so that potential of the other electrode 7 is impressed to the starting aid conductor 8. FIG. 3 shows curves showing relation between a distance "f" from the end tip of the electrode 6 to the end tip of the starting aid conductor 8 and starting voltages (a D.C. voltage is used for the experiment). The parameters 350 Torr, 250 Torr and 20 Torr of these curves are pressures of xenon gas filled in the tube envelope 1. As shown by FIG. 3, it is found that the starting voltage becomes smallest when the end tip of the starting aid conductor 8 nears most to the electrode 6 and further becomes to face or overlaps with side wall 1 inbetween. As a conclusion, it is found that the starting voltage is dependent on the distance "f" between the end tip of the starting aid conductor 8 and the end tip of the electrode 6, and the starting voltage becomes lower as the distance "f" becomes shorter.

Figure 4:
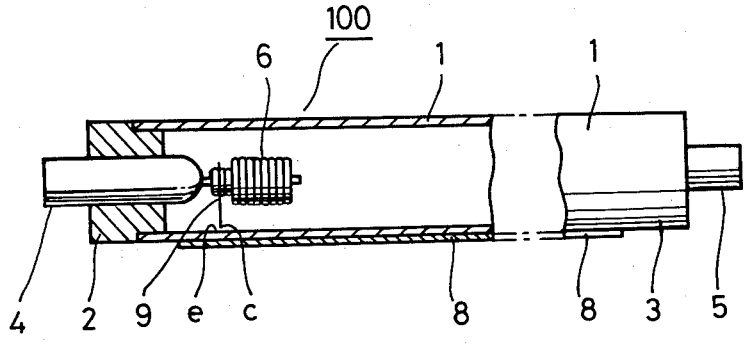
FIG. 4 is an enlarged fragmental elevation view of a discharge tube of a high pressure sodium vapor discharge lamp embodying the present invention.
Figure 5:
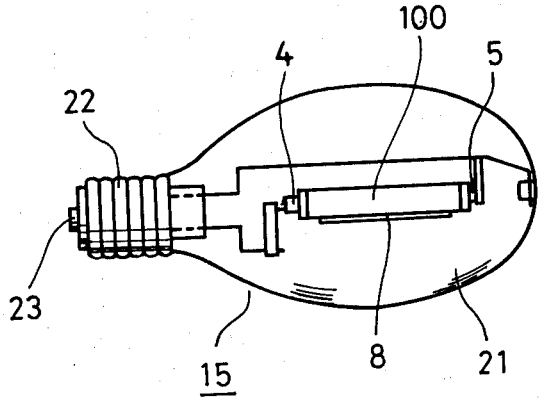
FIG. 5 is a side view of a high pressure sodium vapor discharge lamp in accordance with the present invention, wherein the discharge tube 100 shown in FIG. 4 is sealed in an evacuated glass bulb 21.
Figure 6:
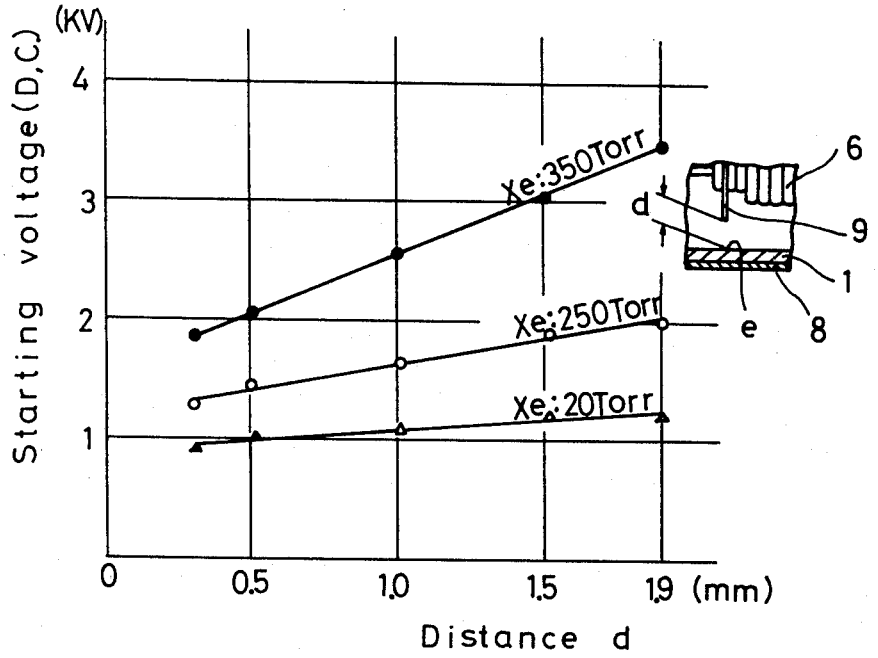
FIG. 6 is a graph showing relations between gap "d" from the end tip of a conductor protrusion 9 of an electrode 6 to the inside surface of a tube wall of the discharge tube of FIG. 4 and starting voltages for D.C. operations of the lamp of FIGS. 4 and 5.

By using an alumina discharge tube, which has an inner diameter of 7.4 mm, a tube thickness of 0.7 mm and a distance of 83 mm between the electrodes, and is for a 360 W high pressure sodium vapor discharge lamp, such further experiments are made that a projection conductor 9 is formed to extend from the electrode 6 as shown in FIG. 4, and the starting voltages are measured for various gaps "d" between the end tip of the projection conductor 9 and the inside surface "e" of the tube wall 1. A molybdenum rod of 0.7 mm diameter is used as the projection conductor 9 and is fixed to a stem part of the tungsten coil of the electrode 6 by spot welding. FIG. 5 is a side view of a high pressure sodium vapor discharge lamp in accordance with the present invention, wherein the discharge tube 100 shown in FIG. 4 is sealed in an evacuated glass bulb 21. FIG. 6 shows results of the experiments, which, in comparison with the curves of FIG. 3, show a drastic improvement of the starting voltage by the provision of the projection conductor 9.

Similar experiments were made for the lamps of various wattages, and similar results were obtained. Especially for high power lamp of 700 W and 1000 W, the starting voltages are remarkably lowered. This can be elucidated that, in such high power lamps, wherein the gap "d" between the end surface of the electrode and the inside surface "e" of the tube wall 1 is large and hence a providing of only a starting aid conductor 8 on the outside surface of the tube wall 1 does not remarkably lower the starting voltage, such providing of the projection conductor 9 extending towards the starting aid conductor 8 can effectively raises potential gradient in the gap.

An example manufactured embodying the present invention is as follows:

| | | |
|---|---|---|
| tube input power | | 360W |
| discharge tube 1: | inner diameter | 7.4mm |
| | thickness of tube | 0.7mm |
| | inter electrode distance | 83mm |
| | material | single crystal alumina |
| electrodes 6 and 7: | outer diameter of coil | 3.6mm |
| starting aid conductor 8: | molybdenum wire of | 0.8mm |
| projection conductor 9: | molybdenum wire of | 0.7mm |
| distance "d" | | 0.5mm |
| sealed gas: | sodium | 4.5mg |
| | mercury | 20mg |
| | xenon gas | 350 Torr |

Figure 7:
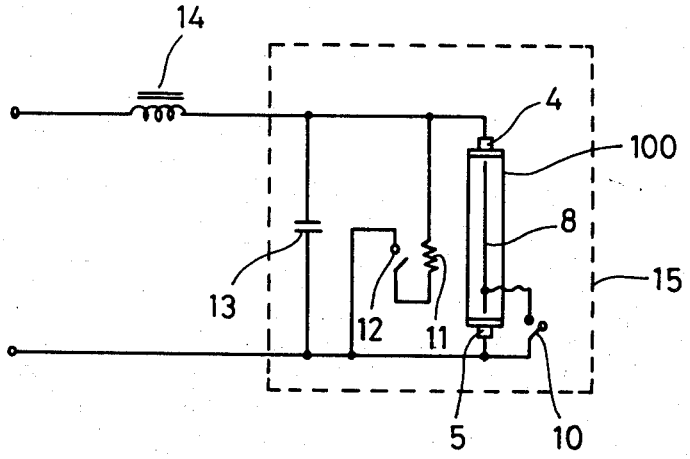
FIG. 7 is a circuit diagram of the lighting apparatus utilizing the lamp of FIG. 5.

The starting aid conductor 8 is connected to the electrode 7 through a bimetal switch 10 as shown in FIG. 7, which is made open by means of a high temperature of the discharge tube 1, in order to disconnect the starting aid conductor 8 from the opposite electrode 7 after ignition to prevent loss of sodium from the discharge tube due to unnecessary connection of the starting aid conductor 8 to the opposite electrode 7.

The circuit of the lamp of this example is shown in FIG. 7, wherein commercial A.C. current is fed through a single choke ballast 14 for conventional 400 W mercury lamp into the high pressure sodium vapor discharge lamp 15 in accordance with the present invention, wherein, in the bulb 21 or in the stem 22, are provided a bimetal starter switch 12, a series resistor 11, a 3000 pF ceramic capacitor 13 and the bimetal switch 10. As shown in FIG. 7, the capacitor 13 and a series connection of the resistor 11 and the switch 12 are connected in parallel across the terminals 4 and 5 of the discharge tube, so that the lamp 15 can be started by known producing of a kick voltage by the choke coil 14. The series resistor 11 is to limit the cut-off current of the bimetal starter switch 12 to the value of 0.5 A and also serves to make the bimetal starter switch 12 open by a joule heat thereof. The capacitor 13 is for controlling to suppress a producing of an extraordinary high kick voltage and also to shape the kick voltage pulse to have a necessary pulse width. Namely, the capacitor 13 serves to protect the lamp apparatus from insulation breakdown damage and also assure certainty of starting. Tests show that the starting voltage for the 360 W lamp of the abovementioned example is about 2 KV, and on the other hand, average value of induced high voltages across the terminals of the discharge tube 100 is about 2.5 KV, which is sufficiently higher than the starting voltage of the lamp, and therefore the lamps are started with a high certainty. Furthermore, on account of lowness of the induced high voltage in the lamp apparatus in comparison with the conventional high pressure sodium vapor discharge lamps, there have been no insulation breakdowns of ballast and circuit during burning tests of the lamps.

Another example of 630 W lamp is made by embodying the present invention and with similar details of the design except the following changes:

| | |
|---|---|
| the inner diameter of polycrystalline alumina discharge tube | 9.7mm |
| the inter-electrode distance | 130mm |
| distance "d" | 0.5mm |

The abovementioned 630 W lamp example has such low starting voltage as almost equal to that of the abovementioned example of 360 W lamp, while starting voltage of a 630 W lamp having similar making but no projection conductor 9 has a starting voltage of 4.5 KV, that is higher by about 1.0 KV than that of the abovementioned 360 W lamp. The abovementioned 630 W lamp can be certainly and stably started by utilizing conventional single choke ballast for 700 W mercury lamp.

It has been confirmed that the shape of the projection conductor 9 need not necessarily be in a rod shape, but can be shaped in a ring or a disk. The importance of the projection conductor 9 is that the distance "d" between the inner surface "e" of the tube wall 1 and the outer end of the projection conductor 9 is in a range of certain short distance. The distance "d" should be from 0.3 mm to 0.7 mm. When the distance "d" is longer than 0.7 mm, the lowering of starting voltage is not satisfactory. On the other hand, when the distance "d" is shorter than 0.3 mm, due to smallness of the gap, every igniting discharges always concentrates in a very small area, and hence the very small area is likely to receive an undesirable effect, thereby inducing a high possibility of making cracks of the tube envelope. Tests show that the optimum distance is between 0.4 mm to 0.6 mm.

What we claim is:

1. A high pressure sodium vapor discharge lamp comprising an outer bulb enclosing a discharge tube in an evacuated space therein, said discharge tube comprising a translucent and chemically stable tube envelope of alumina containing therein sodium, xenon gas, a buffer gas which is at least one member selected from the group consisting of mercury and cadium, and discharge electrodes sealed in both end parts of said tube envelope, characterized in that at least one of said discharge electrodes has a projection conductor which is disposed extending therefrom towards and in proximity to an inside surface of a side wall of said tube envelope with a predetermined gap inbetween, that a starting aid conductor is disposed lengthwise on the outside surface of said side wall in a manner to face the outer end part of said projection conductor via said side wall, said starting aid conductor having a connection which impresses a potential substantially idential to that of the other discharge electrode, and that said xenon gas is sealed to have a pressure of 150 Torr or more, and that said predetermined gap between the outer end of said projection conductor and the inside surface of said side wall is between 0.3 mm to 0.7 mm.

2. A high pressure sodium vapor discharge lamp in accordance with claim 1, wherein said connection contains a switch which opens after starting of discharge of said discharge tube.

3. A high pressure sodium vapor discharge lamp in accordance with claim 2, wherein said switch is a bimetal switch which opens when exposed to a heat of said discharge tube.

4. A high pressure sodium vapor discharge lamp in accordance with claim 1, wherein said discharge lamp further comprises a capacitor and a series connection a starting switch and a current adjusting resistor connected in series each other, both said capacitor and said series connection are connected in parallel across both of said discharge electrodes.

5. A high pressure sodium vapor discharge lamp in accordance with claim 1, wherein said projection conductor and said starting aid conductor are molybdenum wires.

* * * * *